United States Patent [19]

Craig et al.

[11] Patent Number: 4,720,479

[45] Date of Patent: Jan. 19, 1988

[54] CARBONLESS PAPER SHEET MATERIALS

[75] Inventors: Amy J. K. Craig, Chicago, Ill.; Mark A. Burns, Lowell, Ind.; Mary J. Monjes, Bolingbrook, Ill.

[73] Assignee: Daubert Coated Products, Inc., Chicago, Ill.

[21] Appl. No.: 56,394

[22] Filed: Jun. 1, 1987

[51] Int. Cl.[4] ..... B41M 5/16

[52] U.S. Cl. ..... 503/200; 283/81; 427/152; 428/40; 428/211; 428/352; 428/447; 428/914; 503/226

[58] Field of Search ..... 283/81; 427/150–152; 428/40, 211, 352, 447, 914; 503/200, 226

[56] References Cited

U.S. PATENT DOCUMENTS

| | | | |
|---|---|---|---|
| 4,121,856 | 10/1978 | Brunette | 283/81 |
| 4,583,765 | 4/1986 | Messinger | 283/81 |
| 4,664,416 | 5/1987 | Steidinger | 283/81 |

*Primary Examiner*—Bruce H. Hess

*Attorney, Agent, or Firm*—Wallenstein, Wagner, Hattis, Strampel & Aubel, Ltd.

[57] ABSTRACT

A sheet material for use in the production of multi-part pressure sensitive adhesive articles such as labels. In one of its forms, the sheet material consists carbonless paper having a coating or film of a silicone release agent on the imageable side thereof. In other of its forms, a coating or layer of a polymer composition, which acts to accelerate curing the silicone release agent, is interposed between the imageable side of the self-contained carbonless paper and the coating or film of silicone release agent.

17 Claims, 5 Drawing Figures

CARBONLESS PAPER SHEET MATERIALS

TECHNICAL FIELD

The present invention relates to sheet materials comprising as an essential component a self-contained carbonless release paper. In particular, the present invention relates to multi-part pressure sensitive adhesive articles such as labels, tags, tickets, and the like, incorporating as an essential component a self-contained carbonless release paper.

BACKGROUND OF THE PRIOR ART

Self-contained carbonless paper heretofore used to produce multi-part pressure sensitive adhesive labels, for example, is coated with a film of polyethylene via extrusion. The thusly coated paper is then provided with a release coating on the polyethylene layer. The resulting polyethylene coated self-contained carbonless release paper, when utilized in the fabrication of multi-part pressure sensitive adhesive articles such as labels, has numerous shortcomings and disadvantages. Included among these are its tendency to curl excessively, poor image quality, poor conformance to small diameter bottles, excessive stiffness, poor heat resistance during processing, poor vapor transmission, poor die-cuttability, inconsistent release properties, and perhaps most importantly, especially with papers wherein the polyethylene film is applied separately, after the paper is made, a propensity to delaminate at the interface between the carbonless paper and the polyethylene film. Delamination usually manifests itself after the polyethylene coated paper is formed into a label when the bond between the paper and the polyethylene film is weaker than the bond between the pressure sensitive adhesive layer and the release coating on the surface of the film of polyethylene.

BRIEF SUMMARY OF THE INVENTION

In accordance with the present invention, sheet materials for use in the production of multi-part pressure sensitive adhesive articles such as labels, tags, tickets, and the like, have been evolved which overcome all of the numerous shortcomings and disadvantages of multi-part pressure sensitive adhesive articles formed from polyethylene coated carbonless release papers. The sheet materials of the present invention are characterized by their excellent imageability, providing crisp, sharp and clean black or blue images having maximum contrast and readability. The sheet materials are further characterized by their die-cuttability properties, a feature which permits them to be used as a base liner which can also be easily perforated and hole punched, two necessities in the computer-fed forms industry. The sheet materials of this invention also are characterized by their lay-flat properties, resulting in easier processing for converters and end users. The sheet materials have excellent heat resistance, being capable of withstanding temperatures upward of 400° F. without blistering or dulling. A further significant property of the sheet materials is their breathability, enabling the pressure sensitive adhesive diluent, whether it be an organic solvent or water, to back-diffuse through the sheet materials without causing fisheyes, blisters, or bubbles on the surface of the adhesive. The sheet materials, in addition, have excellent release properties, enabling easy removal of labels, for example, but controlled enough so that the labels do not "pop-off" or pre-release when passing over a sharp angle in a printer or typewriter. The release properties of the sheet materials can be varied to meet the particular needs of the environment in which the sheet materials are to be used.

In accordance with one aspect of the invention, the sheet materials consist essentially of a base sheet of self-contained carbonless paper having an imageable side, and a continuous film or layer of a silicone release agent on the imageable side of the self-contained carbonless paper.

In accordance with another aspect of the invention, the sheet materials consist essentially of a base sheet of self-contained carbonless paper having an imageable side, a continuous layer of a polymer composition on the imageable side of the self-contained carbonless paper, and a continuous film or layer of a silicone release agent on the layer formed by the polymer composition. The polymer composition is characterized in that it acts to provide a barrier which can mask or shield any cure-inhibiting agents which may be present on the carbonless paper thereby enabling curing of the silicone release agent to take place at an accelerated rate. The number of layers or tiers of sheet material used in the production of multi-part pressure sensitive adhesive labels, for example, can be varied as desired. Multi-part pressure sensitive adhesive articles incorporating the sheet materials also advantageously will include a sheet of face paper for receiving an image which is reproduced on the imageable side of the self-contained release paper, and a protective release coated backing sheet.

The foregoing, and other advantages and features of the sheet materials of this invention will become apparent from the detailed description to follow taken in conjunction with the accompanying drawings.

DETAILED DESCRIPTION OF THE INVENTION

Figure 1:
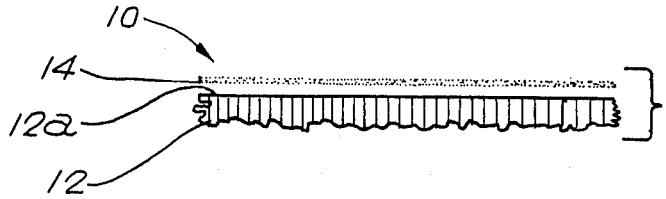
FIG. 1 is an enlarged exploded, schematic view of an embodiment of the sheet materials of the present invention.

As shown in FIG. 1, the sheet material designated generally by reference numeral 10, in one of its forms consists essentially of a base sheet 12 of a self-contained carbonless paper, having an imageable surface or side **12*a*, and a coating or film 14 of a silicone release agent. The base sheet 12 is available commercially in weights ranging from about 30 pounds per 3000 square feet to about 60 pounds per 3000 square feet in thicknesses of the order of about 2.5 to about 5 mils. The imageable side of the base sheet 12** can be selected to provided either a black or a blue image, as desired.

The coating or film 14 of silicone release agent can be formed by a number of such agents. Exemplary thereof are solvent dispersions or aqueous emulsions of organopolysiloxanes. Especially preferred are organopolysiloxane solvent dispersions and aqueous emulsions sold under the designations "SYL-OFF 294" (Dow Corning), "SYL-OFF 23" (Dow Corning), "SS 4191" (General Electric), and "SYL-OFF 1171" (Dow Corning). A catalyst is added to the organopolysiloxanes as a curing agent for the silicone and crosslinking compounds. Such catalysts are commecially available under the designations "SYL-OFF 1171 A" (Dow Corning), "176 Catalyst" and "23 Catalyst" (Dow Corning), and "SS 4192 Catalyst" (General Electric). Curing of the silicone release agent can be accelerated by the use of fast-cure additives. Exemplary of such additives are the polysiloxane solution sold under the designation "SS 4259" (General Electric) and an amino-functional siloxane solution sold under the designation "Q 2-7131" (Dow Corning).

The amount, or loading, of the silicone release agent on the imageable side 12*a* of the base sheet 12 is somewhat variable. The generally optimum objectives of the invention are attained with loadings in the range of about 0.2 to about 1.5 pounds per 3000 square feet of base sheet.

Figure 2:
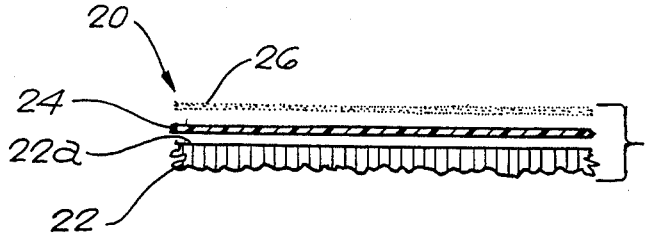
FIG. 2 is an enlarged exploded, schematic view of another embodiment of the sheet materials of the invention.

The embodiment of the invention illustrated in FIG. 2, and designated generally by reference numeral 20, consists essentially of a base sheet 22 of a self-contained carbonless paper having an imageable side 22*a*, a coating or layer 24 of a polymer composition, and a coating or film 26 of a silicone release agent. The base sheet 22 and the silicone release coating or film 26 advantageously are the same as the base sheet 12 and the release coating or film 14 of the embodiment of the invention shown in FIG. 1.

The polymer coating or layer 24 desirably is formed of a polymer composition which is characterized in that it acts to provide a barrier which masks or shields any cure-inhibiting agents which may be present on the carbonless paper thereby enabling curing of the silicone release coating or film 26 to take place at an accelerated rate. While various polymer compositions manifest such a fast-cure effect, cellulosic polymers, and blends of such polymers are preferred. Specific examples of cellulosic polymers useful in the practice of the present invention are carboxymethylcellulose and hydroxyethylcellulose, and blends or mixtures thereof. Exemplary of other polymers which can be used are acrylic copolymers and terpolymers sold under the designation "HYCAR 26138" (B. F. Goodrich), or vinyl polymers available commercially under the designation "GEON 52" (B. F. Goodrich).

The polymer composition can vary in solids content from about 2% to about 60%, and can have a viscosity in the range of about 20 to about 300 cps. The polymer composition loading on the imageable side 22*a* of the base sheet 22 can be in the range of about 0.1 to about 4 dry pounds per 3000 square feet of base sheet.

Figure 3:
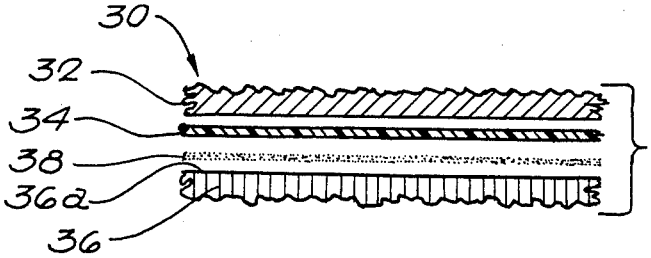
FIG. 3 is an enlarged exploded, schematic view of the embodiment of FIG. 1 incorporated in a multi-part pressure sensitive adhesive article.
Figure 4:
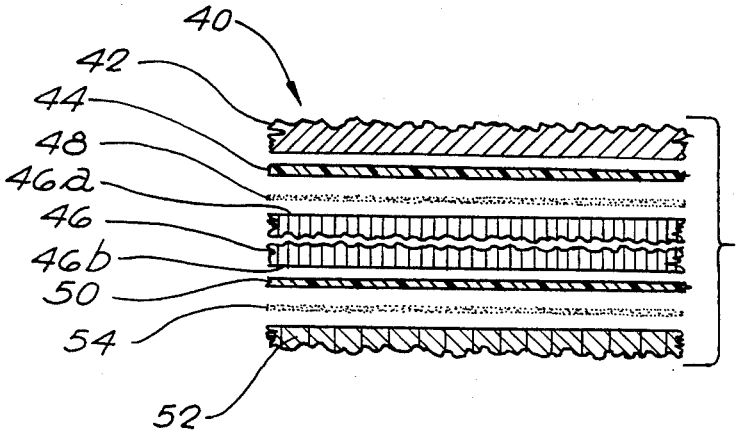
FIG. 4 is an enlarged exploded, schematic view of the embodiment of FIG. 1 incoporated in another form of a multi-part pressure sensitive adhesive article.
Figure 5:
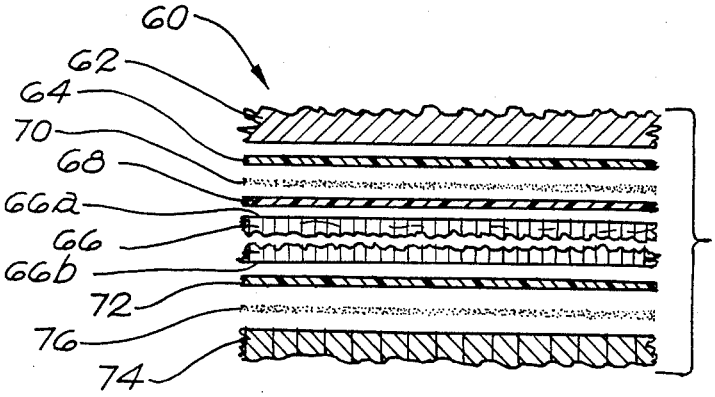
FIG. 5 is an enlarged exploded, schematic view of the embodiment of FIG. 2 incorporated in a multi-part pressure sensitive adhesive.

As stated hereinabove, the sheet materials of the present invention can be used to produce multi-part pressure sensitive adhesive articles such as labels, tags, tickets, and the like. In FIGS. 3, 4 and 5, different, representative embodiments of multi-part pressure sensitive adhesive articles are schematically illustrated. The embodiment shown in FIG. 3, and designated generally by reference numeral 30, comprises a sheet of label face paper 32 having a coating or layer 34 of a pressure sensitive adhesive on the lower surface thereof, and a sheet material consisting essentially of base sheet 36 of a self-contained carbonless paper, having a coating or film 38 of a silicone release agent, as described hereinabove with regard to the embodiment of the invention shown in FIG. 1. The label face paper 32 is of a standard type of image-receiving paper. Any image imprinted or impressed with sufficient pressure on the outer surface of the paper 33 is duplicated on the imageable side 36*a* of the base sheet 36.

The embodiment of the invention illustrated in FIG. 4, and designated generally by reference numeral 40, comprises a sheet of label face paper 42 having a coating or layer 44 of a pressure sensitive adhesive on the bottom surface thereof. A base sheet 46 consisting essentially of a self-contained carbonless paper having a coating or film of a silicone release agent 48 on the imageable side 44*a* thereof is releasably adhered to the layer 44 carried by the face paper 42. The base sheet 46, in turn, is provided with a coating or layer 50 of a pressure sensitive adhesive on the bottom side 46*b* thereof. A protective backing sheet 52, having a coating or layer 54 of a silicone release agent, is adhered to the base sheet 46. Again, any image imprinted or impressed on the outer surface of the face paper 42 will be duplicated on the imageable side 46*a l of the base sheet 46.*

The embodiment of the invention shown in FIG. 5, and designated generally by reference numeral 60, comprises a sheet of label face paper 62 having a coating or layer 64 of a pressure sensitive adhesive on the undersurface thereof. Adhered to the layer 64 is a sheet material consisting essentially of a base sheet 66 of a self-contained carbonless paper having an imageable side 66*a* on which is applied a coating or layer 68 of a polymer composition of the type described hereinabove. The layer 68, in turn, is provided with a coating or film 70 of a silicone release agent. The lower, or non-imageable side 66*b* of the base sheet 66 has a coating or layer 72 of a pressure sensitive adhesive. Adhered to the base sheet is a protective backing sheet 74 to the upper surface of which is applied a coating or film 76 of a silicone release agent. As in the case of the embodiments of the invention shown in FIGS. 3 and 4, any lettering, or other indicia, imprinted or impressed with sufficient pressure on the exposed surface of the label face paper 62 will be clearly and sharply duplicated on the imageable side 66*a* of the self-contained carbonless paper. In this connection, it should be noted that the number of base sheets incorporated into the structures, as represented by FIGS. 3, 4 and 5, can be increased to produce as many copies as desired of any indicia printed or impressed on the outer surface of the label face paper component of the structures. Thus, 2, 3, 4, or more, copies of such indicia may be made using a single structure as described herein.

The pressure sensitive adhesive employed to form the coatings or layers 34, 44, 50, 64 and 72 of the structures shown in FIGS. 3, 4 and 5 may be formed from various solvent, water based, or hot melt formulations. Representative of a water based pressure sensitive adhesive useful for the purposes of this invention is a blend of water-insoluble polyacrylic latex and a water-insoluble resin of the type disclosed in U.S. Pat. No. 4,564,010. The properties of the adhesives can be varied to meet specific requirements by the addition of thickening agents, binders, and the like, in accordance with known practices.

The following examples are illustrative of specific formulations for use in the manufacture of the sheet materials of the present invention. The ingredients are shown in dry parts by weight.

EXAMPLE 1

| Ingredient | Parts Dry |
|---|---|
| A. Polymer Composition | |
| Carboxymethyl Cellulose (Hercules) | 2.5 |
| Hydroxyethyl Cellulose (Union Carbide) | 2.0 |
| B. Silicone Release Agent | |
| Syl-Off 294 (Dow Corning) | 12.0 |
| Q2-7131 (Dow Corning) | .84 |
| 176 Catalyst (Dow Corning) | 1.35 |

EXAMPLE 2

| Ingredient | Parts Dry |
|---|---|
| A. Polymer Composition | |
| Hycar 26138 (B. F. Goodrich) | 100.00 |
| B. Silicone Release Agent | |
| Syl-Off 1171 (Dow Corning) | 20.0 |
| Syl-Off 1171A (Dow Corning) | 1.5 |

In utilizing the foregoing compositions in the manufacture of the sheet materials, a web of a self-contained carbonless paper is fed continuously to a first coating station where the polymer composition is applied by a Meyer rod to the imageable side of the paper. The coated paper then is passed through an oven where the polymer composition is dried at a temperature of about 250° to about 350° F. As the coated paper leaves the oven, it passes through two idler rollers which act to turn the paper over so that the coated side can be recoated at a second coating station. The polymer composition coated paper is first cooled on cooling drums and is then fed directly to the second coating station where the silicone release agent is applied to the polymer composition coating by a Meyer rod. The dual coated paper is then passed into an oven, first passing over an air cap which facilitates evaporation of diluent. In the oven, the silicone relaese agent coating is cured at a web temperature of about 300° to about 400° F. As the coated sheet material leaves the oven, it is passed over a heated drum from where it is directed to a winder. The rate of travel of the paper web during processing can range from about 200 to about 1500 feet/minute.

What is claimed is:

1. A sheet material for use in the production of multipart pressure sensitive adhesive labels, tags, tickets, and the like, consisting essentially of a base sheet of self-contained carbonless paper having an imageable side; and a continuous film of a silicone release agent on said imageable side of the self-contained carbonless paper.

2. A sheet material according to claim 1 wherein the silicone release agent is an organopolysiloxane.

3. A sheet material for use in the production of multipart pressure sensitive adhesive labels, tags, tickets, and the like, consisting essentially of a base sheet of self-contained carbonless paper having an imageable side; a continuous layer of a polymer composition on the imageable side of the self-contained carbonless paper, said polymer composition being characterized in that it acts to provide a barrier which masks or shields any silicone release agent cure-inhibiting factors present on the carbonless paper; and a continuous film of a silicone release agent on said layer of the polymer composition.

4. A sheet material according to claim 3 wherein the polymer composition comprises a cellulosic polymer.

5. A sheet material according to claim 4 wherein the cellulosic polymer is carboxymethylcellulose or hydroxyethylcellulose.

6. A sheet material according to claim 4 wherein the polymer composition comprises a mixture of cellulosic polymers.

7. A sheet material according to claim 6 wherein the mixture comprises a blend of carboxymethylcellulose and hydroxyethylcellulose.

8. A sheet material according to claim 3 wherein the loading of the polymer composition ranges from about 0.1 to about 4 dry pounds per ream of sheet material.

9. A sheet material according to claims 1 or 3 wherein an image-receiving face paper having a layer of a pressure sensitive adhesive on the non-image-receiving side thereof is applied to the film of silicone release agent on the imageable side of the self-contained carbonless paper.

10. A sheet material according to claims 1 or 3 wherein a layer of a pressure sensitive adhesive is provided on the side of the self-contained carbonless paper opposite to the imageable side thereof.

11. A sheet material according to claim 10 wherein a sheet material consisting essentially of a base sheet of self-contained carbonless paper, having an imageable side on which is formed a film of a silicone release agent, is adhered to said layer of a pressure sensitive adhesive on said opposite side of the self-contained carbonless paper.

12. A sheet material according to claim 3 wherein the silicone release agent is an organopolysiloxane.

13. A sheet material according to claim 3 wherein the polymer composition comprises acrylic copolymers and/or terpolymers.

14. A multi-part pressure sensitive adhesive sheet material for use as a labelling vehicle, comprising: an image-receiving face paper having a layer of a pressure sensitive adhesive on the side thereof opposite to the side on which an image is received; at least one base sheet adhered to the layer of pressure sensitive adhesive on said side of the face paper, said base sheet consisting essentially of a self-contained carbonless paper having an imageable side and a non-imageable side, and having a film of a silicone release agent on the imageable side thereof and a layer of a pressure sensitive adhesive on the non-imageable side thereof; and a release coated backing sheet adhered to the layer of pressure sensitive adhesive on said base sheet.

15. A multi-part pressure sensitive adhesive sheet material for use as a labelling vehicle, comprising an image-receiving face paper having a layer of a pressure sensitive adhesive on the side thereof opposite to the side on which an image is received; at least one base sheet adhered to the layer of pressure sensitive adhesive on said side of the face paper, said base sheet consisting essentially of a self-contained carbonless paper having an imageable side and a non-imageable side, and having a continuous layer of a polymer composition on the imageable side thereof, said polymer composition being characterized in that it acts to provide a barrier which masks or shields any silicone release agent cure-inhibiting factors which may be present on the carbonless paper, said layer of the polymer composition having a continuous film of a silicone release agent thereon, said base sheet further having a layer of a pressure sensitive adhesive on the non-imageable side thereof; and a release coated backing sheet adhered to the layer of pressure sensitive adhesive on the non-imageable side of the base sheet.

16. A sheet material according to claim 15 wherein the polymer composition comprises a cellulosic polymer.

17. A sheet material according to claim 16 wherein the cellulosic polymer is a member of the group selected from carboxymethylcellulose and hydroxyethylcellulose, and mixtures thereof.

* * * * *